US011434861B2

(12) United States Patent
Silva et al.

(10) Patent No.: US 11,434,861 B2
(45) Date of Patent: Sep. 6, 2022

(54) IGNITION COIL FOR AN INTERNAL COMBUSTION ENGINE AND METHOD FOR MANUFACTURNG THE SAME

(71) Applicant: ELDOR CORPORATION S.P.A., Orsenigo (IT)

(72) Inventors: Stefano Silva, Cantù (IT); Simone Pennati, Besana in Brianza (IT); Pasquale Forte, Castiglione d'Orcia (IT)

(73) Assignee: ELDOR CORPORATION S.P.A., Orsenigo (IT)

( * ) Notice: Subject to any disclaimer, the term of this patent is extended or adjusted under 35 U.S.C. 154(b) by 0 days.

(21) Appl. No.: 17/265,483

(22) PCT Filed: Jul. 30, 2019

(86) PCT No.: PCT/IB2019/056474
§ 371 (c)(1),
(2) Date: Feb. 2, 2021

(87) PCT Pub. No.: WO2020/031020
PCT Pub. Date: Feb. 13, 2020

(65) Prior Publication Data

US 2021/0199083 A1 Jul. 1, 2021

(30) Foreign Application Priority Data

Aug. 6, 2018 (IT) ..... 102018000007876

(51) Int. Cl.
*F02P 3/055* (2006.01)
*H01F 27/02* (2006.01)
*H01F 38/12* (2006.01)

(52) U.S. Cl.
CPC ..... *F02P 3/055* (2013.01); *H01F 27/022* (2013.01); *H01F 38/12* (2013.01)

(58) Field of Classification Search
CPC ..... H02P 3/055; H02P 3/0442; H01F 27/022; H01F 27/40; H01F 38/12
See application file for complete search history.

(56) References Cited

U.S. PATENT DOCUMENTS 5,191,872 A * 3/1993 Takaishi ..... F02P 3/02 123/634
5,708,566 A * 1/1998 Hunninghaus ..... H05K 1/0206 174/252

(Continued)

FOREIGN PATENT DOCUMENTS

DE 102010062349 A1 6/2012

OTHER PUBLICATIONS

International Search Report and Written Opinion dated Nov. 13, 2019 from counterpart International Patent Application No. PCT/IB2019/056474.

(Continued)

*Primary Examiner* — Phutthiwat Wongwian
*Assistant Examiner* — Sherman D Manley
(74) *Attorney, Agent, or Firm* — Shuttleworth & Ingersoll, PLC; Timothy J. Klima

(57) ABSTRACT

A method for manufacturing an ignition coil for an internal combustion engine includes manufacturing a containment body provided with a containment chamber, defining an internal volume, and with a lateral seat facing outwards, and preparing an electronic board provided with a first face and a second face, opposite the first. The electronic board is positioned inside said lateral seat and a polymeric material with high thermal conductivity is then printed on the electronic board so as to cover it.

14 Claims, 3 Drawing Sheets

(56) References Cited

U.S. PATENT DOCUMENTS

| | | | | |
|---|---|---|---|---|
| 5,740,787 | A * | 4/1998 | Ando | F02P 3/02 123/635 |
| 5,895,973 | A * | 4/1999 | Fessenden | H01L 24/28 257/713 |
| 6,117,797 | A * | 9/2000 | Hembree | H01L 21/4871 257/E23.125 |
| 6,309,915 | B1 * | 10/2001 | Distefano | H01L 21/568 257/E23.055 |
| 7,443,678 | B2 * | 10/2008 | Han | F21V 29/777 361/704 |
| 9,129,740 | B2 | 9/2015 | Stegmaier | |
| 2003/0222743 | A1 * | 12/2003 | Kondo | F02P 3/02 336/90 |
| 2004/0011342 | A1 * | 1/2004 | Fukatsu | F02P 11/06 123/630 |
| 2008/0282542 | A1 * | 11/2008 | McCutcheon | F28D 15/0241 29/890.039 |
| 2013/0321975 | A1 * | 12/2013 | Stegmaier | H01F 38/12 361/263 |
| 2016/0312756 | A1 * | 10/2016 | Steinberger | H05K 5/0217 |
| 2020/0392933 | A1 * | 12/2020 | Boll | H01F 27/025 |
| 2021/0035732 | A1 * | 2/2021 | Moriyama | H01F 27/025 |

OTHER PUBLICATIONS

Sherman: "Plastics That Conduct Heat", Internet Citation, Jun. 30, 2001 (Jun. 30, 2001), XP887981888, Retrieved from the Internet: URL:http://www.ptonline.com/articles/288186fal.html; [retrieved on Feb. 28, 2007]; p. 1, paragraph 6; p. 2, paragraph 5.

* cited by examiner

IGNITION COIL FOR AN INTERNAL COMBUSTION ENGINE AND METHOD FOR MANUFACTURNG THE SAME

This application is the National Phase of International Application PCT/IB2019/056474 filed Jul. 30, 2019 which designated the U.S.

This application claims priority to Italian Patent Application No. 102018000007876 filed Aug. 6, 2018, which application is incorporated by reference herein.

The present invention relates to an ignition coil for an internal combustion engine and a method for manufacturing the same.

The present invention applies primarily to the automotive sector, and in particular to the production of "smart" ignition coils, i.e. provided with on-board electronics.

In the automotive sector, the development of ignition systems in recent years has been increasingly directed towards the production of "smart" components, capable of independently performing a series of processes or operations which are useful for controlling or monitoring the combustion in the cylinder.

In order to optimize the use of space to meet the stringent dimensional parameters provided by the car makers, solutions have been developed that comprise the integration of an electronic board (or printed circuit board) directly inside the containment body of the coil.

This has clearly highlighted problems concerning occupancy and heat dissipation, related to the sizing and overheating of the electronic components on board the coil.

In order to solve these problems, the prior art provides some solutions, which are not, however, considered as satisfactory at present.

For example, document US2016312756 shows a coil body in which a plug is made for an additional body, containing the control circuit and adapted to be filled with an electrically insulating filler.

Disadvantageously, this document specifically illustrates that the control circuit requires a special dissipation element, whereby its location inside the body significantly reduces its effectiveness.

Moreover, the filler is to be considered useful for the stabilization of the circuits, but it is necessary to place and fasten a cover to ensure the mechanical insulation of the circuit housing, which makes both the structure and the assembly of the coil complex.

A further known solution is published in document U.S. Pat. No. 9,129,740, which describes a "smart" coil with built-in control circuit and housed in the containment body.

In order to increase the heat exchange of the circuit, a layer of a highly conductive material is provided between the printed circuit board and a side wall of the coil body.

In other words, the layer of highly conductive material is packed between the circuit and the plastic wall of the coil body.

Disadvantageously, this solution solves only in part the problems concerning the assembly and overheating of the coil, as the heat dissipation is actually determined by the thermal conductivity of the plastic material the coil body is made of, which must not be too high, as known.

The purpose of the present invention, therefore, is to provide an ignition coil for an internal combustion engine and a method for manufacturing the same, which overcome the drawbacks of the prior art mentioned above In particular, the purpose of the present invention is to provide an ignition coil for an internal combustion engine that is both "smart", particularly efficient and easy to assemble.

A further purpose of the present invention is to provide a method for manufacturing an ignition coil for an internal combustion engine, which shows a high-quality and is cost-effective to produce.

Said purposes are achieved by an ignition coil for an internal combustion engine having the characteristics as disclosed herein, as well as by a method for manufacturing an ignition coil or an internal combustion engine having characteristics as disclosed herein.

In particular, the ignition coil comprises a containment body provided with a containment chamber, defining an internal volume, and with a lateral seat facing outwards, away from said containment chamber.

The coil preferably comprises electric/electronic means for generating high-voltage electrical energy housed in said containment chamber.

A conductive connection element developing along its own main direction between a first end connected to said electric/electronic means and a second end connected to a spark plug is preferably provided.

Preferably, an electronic board is electrically connected to said electric/electronic means and is placed in said lateral seat.

A protection element to protect said electronic board is preferably provided.

According to an aspect of the present invention, the protection element is made of a polymeric material with high thermal conductivity over-moulded on said electronic board so as to close the lateral seat and cover the electronic board.

Advantageously, the board is placed in position inside the lateral seat and both its mechanical positioning and cooling capacity are optimized by simply moulding a polymer material with high thermal conductivity.

The thermal conductivity of said protection element is preferably higher than that of the containment body and is comprised between 0.50 and 5.00 W/mK, more preferably approximately 2.50 W/mk.

Preferably, the protection element further comprises a plurality of heat exchange fins that lead off away from said lateral seat to permit the cooling of the electronic board.

In other words, the polymeric material with high thermal conductivity is injected and moulded into the seat so that, after moulding, the protection element not only incorporates, at least in part, the electronic board, but also has a plurality of heat exchange baffles/fins that promote heat dissipation.

Object of the invention is, as discussed above, also a method for manufacturing an ignition coil for an internal combustion engine, preferably the ignition coil described above.

Preferably, the method comprises manufacturing a containment body provided with a containment chamber, defining an internal volume, and with a lateral seat facing outwards, away from said containment chamber.

Preferably, the method also comprises preparing an electronic board provided with a first face and a second face, opposite the first.

This electronic board is preferably placed in position inside said lateral seat.

A step of moulding a polymeric material with high thermal conductivity on said electronic board so as to cover the electronic board is preferably provided downstream of said positioning.

The step of manufacturing the containment body is preferably performed by means of moulding plastic material in a press.

Therefore, the containment body and the protection element of the electronic board are made of different materials (both polymeric) and in different stations. More precisely, the containment body is made in a dedicated station and the protection element is moulded directly on the containment body, i.e. in the lateral seat.

Advantageously, this speeds up the production step of the coil, which is:

highly resistant from a mechanical point of view;

thermally efficient, thanks to the thermal conductivity of the protection element, that is the only interface between the electronic board and the external environment;

inexpensive, thanks to the simplification of the connection between the electronic board and the external environment.

These and other characteristics, together with the related advantages, will be clearer from the following illustrative, and therefore non-limiting, description of a preferred, and thus non-exclusive, embodiment of an ignition coil for an internal combustion engine and a method for manufacturing the same according to what is shown in the attached drawings, wherein:

FIG. 1 shows a perspective front view, in an exploded representation, of some components of the ignition coil for an internal combustion engine according to the present invention, in a first assembly step;

FIGS. 2 and 2*a* show respectively a front and a rear perspective view of the components of the coil of FIG. 1, in an assembled configuration;

FIGS. 3 and 3*a* show, respectively, a front and a rear perspective view of the ignition coil of FIG. 2 at a later manufacturing stage;

Figure 1:
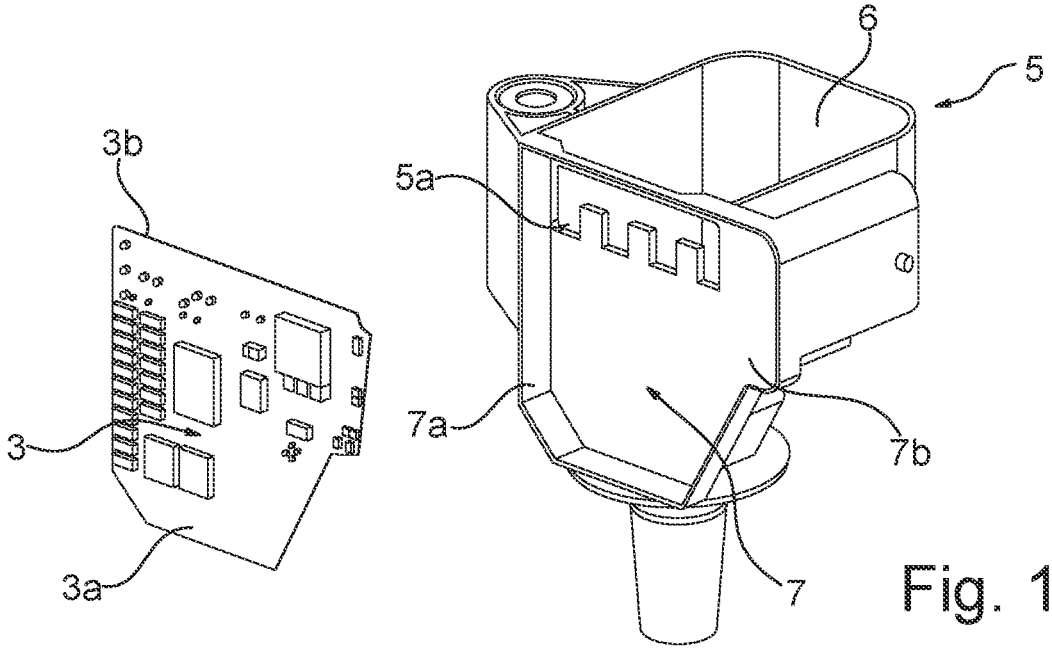
Figure 2A:
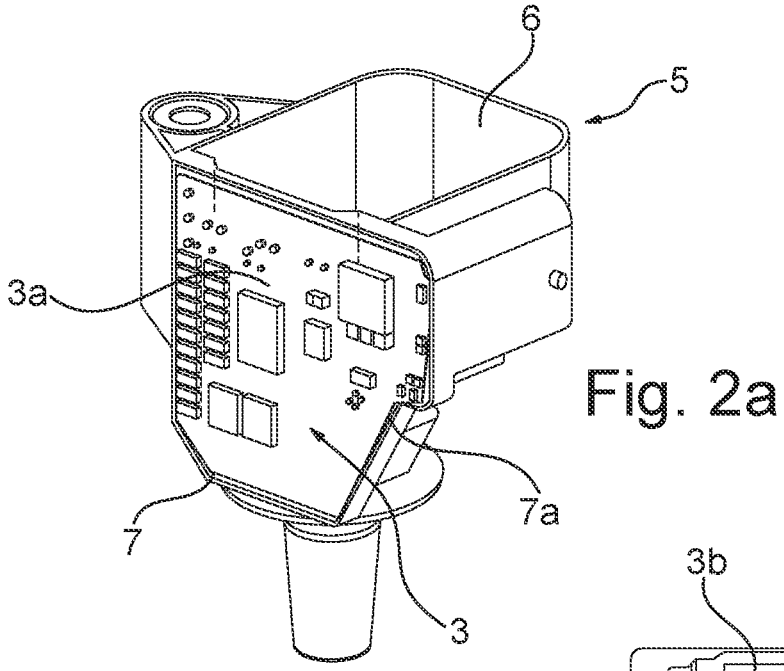
Figure 2B:
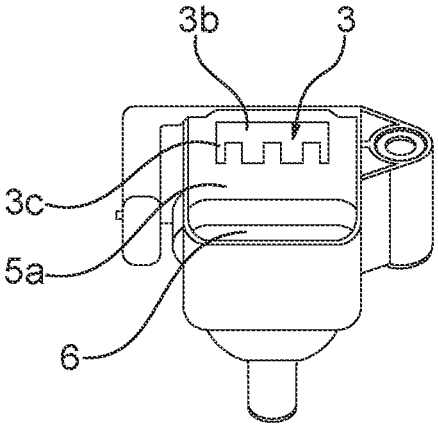
Figure 3A:
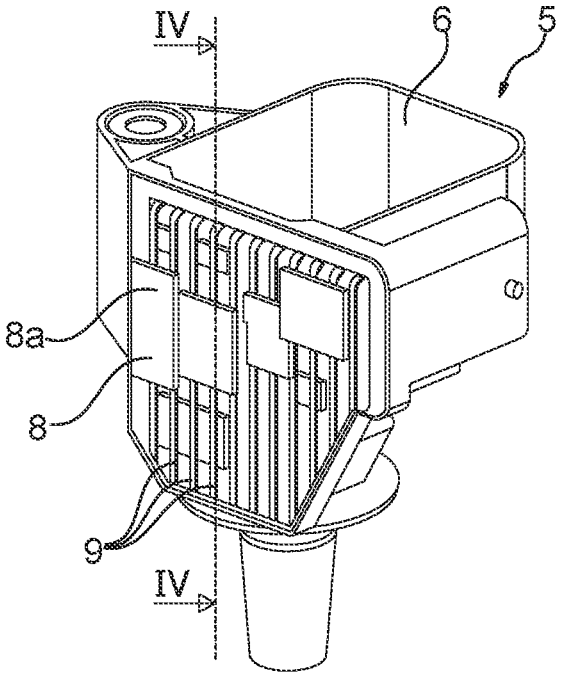
Figure 3B:
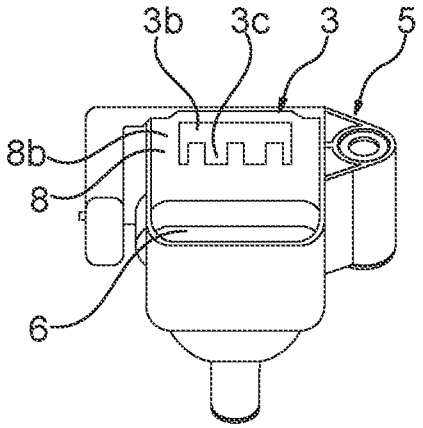
Figure 4:
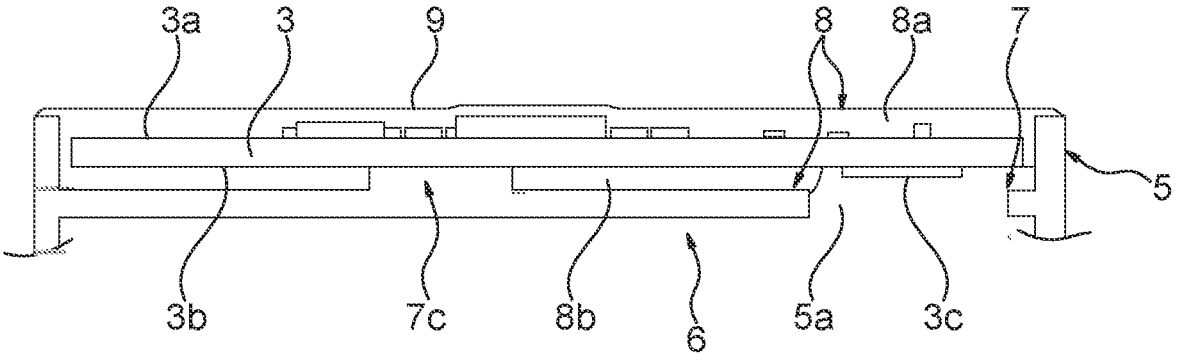
FIG. 4 shows a partial schematic cross-sectional view along the line IV-IV in FIG. 3*a;*
Figure 5:
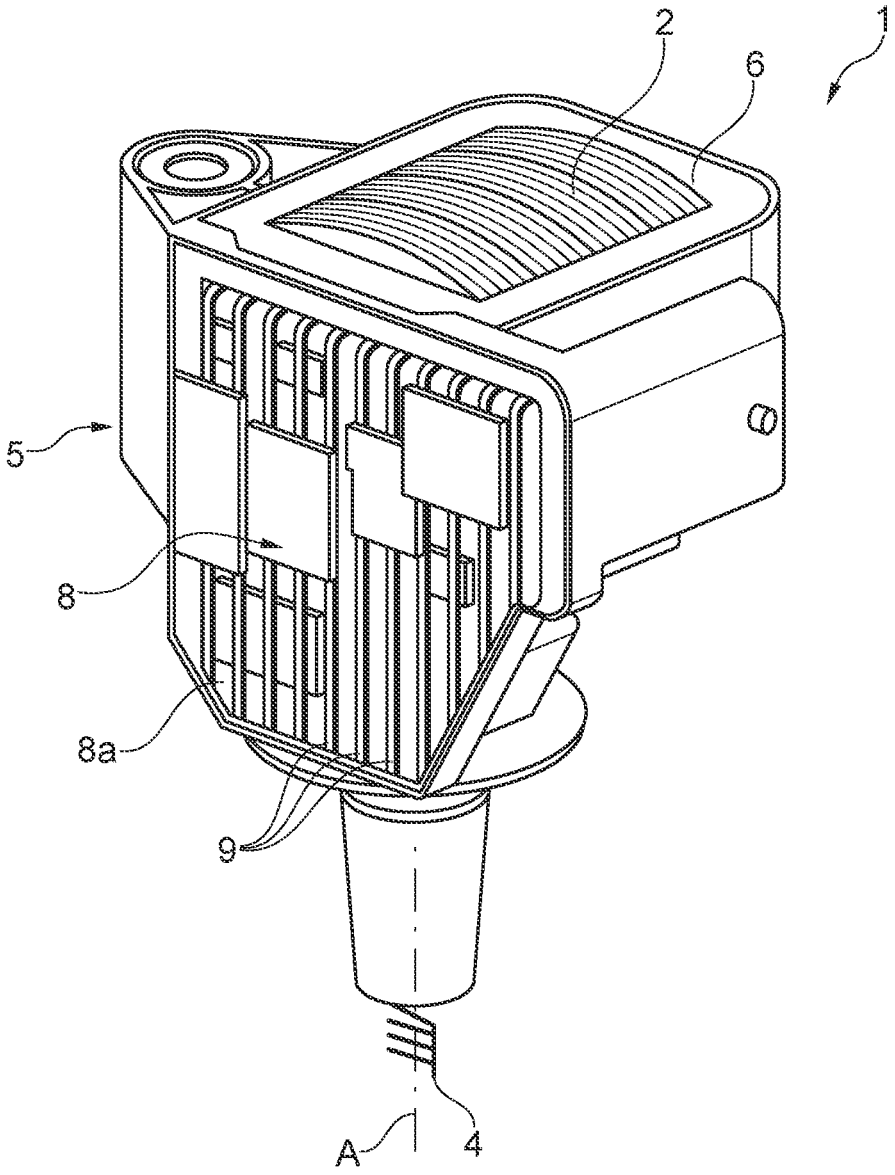
FIG. 5 is a perspective front view of a complete ignition coil.

With reference to the appended Figures, an ignition coil for an internal combustion engine according to the present invention is indicated with number 1.

The ignition coil 1 is a device configured to generate a spark within a cylinder of an internal combustion engine by providing the two electrodes of a spark plug with the voltage needed to break the dielectric allowing the generation of a current flow.

The coil 1 is therefore used together with a voltage (or current) generator, preferably the vehicle battery, and comprises a primary winding and a secondary winding.

These windings, together with the electronics and circuitry that allow the generation of high voltage on the secondary winding, generically define electric/electronic means 2 for generating high-voltage electrical energy.

For example, electric/electronic means 2 comprise one or more of the following components: the primary winding, a switch associated with the primary winding, a voltage regulator, the secondary winding, one or more current/voltage sensing elements, etc.

In order to properly control the electric/electronic means 2 during the generation of the spark, and possibly to make measurements or detections, the coil 1 also comprises an electronic board 3 electrically connected to said electric/electronic means 2.

To allow control, the electronic board 3 comprises one or more connectors 3*c* electrically connected/connectable to the electric/electronic means 2.

Structurally, the electronic board 3 has a plate-like shape, preferably polygonal. The electronic board 3 therefore has a much higher surface development than its thickness. In other words, both surface development dimensions of the electronic board 3 are greater than its thickness.

The electronic board 3 is therefore provided with a first face 3*a* and a second face 3*b*, opposite the first face 3*a*.

Preferably, as will be better explained below, the connectors 3*c* of the electronic board 3 are located on the second face 3*b*.

Preferably, the electronic board 3 is a properly designed printed circuit board with the necessary components for the functions of the coil 1.

A conductive connection element 4 configured to transmit the voltage generated by the induction on the secondary winding to the ends of the spark plug is further provided.

Regardless of its configuration, the conductive element 4 develops along its own main direction "A" between a first end connected to said electric/electronic means 2 and a second end connected to a spark plug.

Structurally, the coil 1 comprises a containment body 5 provided with a containment chamber 6, defining an internal volume, and with a lateral seat 7 facing outwards, away from said containment chamber 6.

In order to provide a good mechanical strength, the containment body 5 is preferably made of a reinforced polymeric material, preferably reinforced with glass fibre.

In addition, in the illustrated embodiment, the material used to manufacture the containment body 5 has a thermal conductivity of less than 0.50 W/mK, preferably about 0.30 W/mK.

For example, the reinforced polymer material may be selected from the following:

PBT,

PPS,

PET,

PA.

The containment body 5 comprises two separate volumes, an internal volume (containment chamber 6) and an external volume or, in any case, facing outwardly and accessible from the outside (lateral seat 7).

The electric/electronic means 2 are housed in the containment chamber 6. The electronic board 3 is placed in the lateral seat 7.

Preferably, the containment body 5 comprises a communication opening 5*a* between containment chamber 6 and the lateral seat 7.

In other words, while defining two distinct volumes, the containment chamber 6 and the lateral seat 7 are communicate with each other in order to allow a simple connection between the electric/electronic means 2 and the electronic board 3.

In this respect, the electronic board 3 preferably comprises one or more connectors 3*c* facing the opening 5*a* to allow contact with the electric/electronic means 2.

In particular, the lateral seat 7 comprises a peripheral edge 7*a* and a back wall 7*b*.

The back wall 7*b* preferably defines a separation septum between the lateral seat 7 and the containment chamber 6.

Preferably, the lateral seat 7 is open and the back wall 7*b*, in a disassembled coil condition, is accessible/visible from the outside.

In its preferred embodiment, the seat 7 has a surface development that is greater than its thickness.

In other words, preferably both development dimensions of the back wall 7*b* are higher than the height of the peripheral edge 7*a*.

In its preferred embodiment, the back wall 7*b* is basically mirrored to the electronic board 3. In other words, the peripheral edge 7*a* is, therefore, substantially countershaped to the electronic board 3.

The communication opening 5*a* is preferably made on the back wall 7*b* of the lateral seat 7.

Therefore, the back wall 7*b* is physically placed between the electronic board 3, located in the lateral seat 7, and the electric/electronic means 2, housed in the containment chamber 6.

More in detail, the electronic board 3 is arranged in the lateral seat 7 so that its first face 3*a* faces outwards (i.e. away) from the lateral seat 7 and its second face 3*b* faces the back wall 7*b* of the lateral seat 7.

Furthermore, the electronic board 3 is preferably placed in the lateral seat 7 so that its second face 3*b* faces the back wall 7*b* and is preferably spaced from it.

In other words, a spacer is provided to create a space or gap with a predetermined thickness between the second face 3*b* of the electronic board 3 and the back wall 7*b* of the lateral seat 7.

This space may be free or, preferably, filled with appropriate material, as will be better explained below.

Moreover, the connectors 3*c* of the electronic board 3 are preferably placed at the opening 5*a*, so as to be connected to the electric/electronic means 2 housed in the containment chamber 6.

According to one aspect of the invention, the coil 1 comprises a protection element 8 of the electronic board 3.

This protection element 8 is designed to overlap the electronic board 3, at least at its first face 3*a*, occluding the lateral seat 7.

According to the invention, the protection element 8 is made of polymeric material with high thermal conductivity, over-moulded on the electronic board 3, so as to cover it and occlude the lateral seat 7.

Preferably, the polymer material with high thermal conductivity has higher conductivity than the material the containment body 5 is made of.

In the preferred embodiment, this thermal conductivity is between 0.50 and 5.00 W/mK, preferably about 2.50 W/mK.

In addition, it is preferable that the polymeric material with high thermal conductivity also has electrical insulation properties.

In this respect, it is preferable that the polymeric material with high thermal conductivity acts as an electrical insulator in its interaction with the component.

The protection element 8 is therefore over-moulded on said electronic board 3 so as to cover the first face 3*a* and at least part of said second face 3*b*.

Thus, the protection element 8 covers the first face 3*a* of the electronic board 3 and at least part of the second face 3*b*, at the space or gap.

The exposed portion 8*a* of the protection element 8 faces outside the containment body 5 and covers the first face 3*a* of the electronic board 3.

A hidden portion 8*b* of the protection element 8 covers at least part of the second face 3*b* of the electronic board 3 and is placed between this second face 3*b* and the back wall 7*b*.

The protection element 8 is preferably over-moulded on said electronic board 3 so as to cover the second face, leaving said one or more connectors 3*c* uncovered.

Therefore, the hidden portion 8*b* of the protection element partially covers the second face 3*b* of the electronic board 3, leaving a portion containing the connectors 3*c* free, i.e. a portion facing the opening 5*a*.

In any case, it should be noted that the protection element 8 and the electronic board 3 are preferably built-in, i.e. inseparable in a reversible manner. This is caused by over-moulding of the polymeric material with high thermal conductivity. In fact, the protection element 8 incorporates at least part of the electronic board 3, being integral to it.

In this respect, the polymeric material with high thermal conductivity preferably covers the electronic board in such a way that any air gaps between the face 3*a*, 3*b* of the electronic board 3 and the respective portion 8*a*, 8*b* of the protective element 8 are eliminated.

Preferably, the protection element 8 comprises a plurality of heat exchange fins 9 that lead off away from said lateral seat 7 to permit the cooling of the electronic board 3.

More precisely, the exposed portion 8*a* of the protection element 8 comprises said plurality of fins 9, which develop side by side crosswise, in particular orthogonally, to the electronic board 3.

Advantageously, in this way, the protection element 8 acts simultaneously as a "cover" for the seat, as a filling material and as dissipator, thereby simplifying the structure and speeding up the manufacturing of the coil 2.

Object of the present invention is also a method for manufacturing an ignition coil 1 for an internal combustion engine, preferably but not exclusively corresponding to the ignition coil 1 described above.

In this regard, and without any loss of generality, the terminology and numerical references used up to now in the description of the device will be maintained, where possible and mutatis mutandis, in the following description of the method according to the invention.

The method comprises, first of all, manufacturing the containment body 5 provided with the containment chamber 6 and the lateral seat 7.

Preferably, as already briefly illustrated in the description of the coil 1, the containment body 5 is made of reinforced plastic material, more preferably glass fibre.

In this respect, in the preferred embodiment, the containment body 5 is made by moulding the plastic (or polymeric) material in a press, preferably a dedicated press.

The electronic board 3 is then prepared, which is provided with a first face 3*a* and a second face 3*b*, opposite the first.

This electronic board 3 is preferably placed in position inside said lateral seat 7.

More in detail, the electronic board 3 is placed in the lateral seat 7 so that its first face 3*a* faces outwards from the lateral seat 7 and its second face 3*b* faces the back wall 7*b* thereof, preferably spaced from it.

Therefore, the electronic board 3 is placed in the lateral seat 7 so as to leave a space or gap with a predetermined thickness between the second face 3*b* of the electronic board 3 and the back wall 7*b* of the lateral seat 7.

In the preferred embodiment, the electronic board 3 is placed so that the connectors 3*c* face the opening 5*a*, in communication with the containment chamber 6.

In the preferred embodiment, after placing it in the lateral seat 7, the electronic board 3 is anchored thereto.

For example, the anchoring means could be defined by the same connectors 3*b* inserted in the opening 5*a* (or in the openings) or by other fastening members, known per se or in any case not directly related to the present invention (e.g. clips or the like).

According to the invention, the method comprises a step of moulding a polymeric material with high thermal conductivity on said electronic board 3 so as to cover it. Once solidified, said polymeric material with high thermal conductivity defines the protection element 8 for the electronic board 3.

The polymeric material with high thermal conductivity is then over-moulded on the electronic board 3 so that the first face 3 is completely covered, occluding the lateral seat 7 (except for the opening 5*a*).

The step of moulding the polymeric material with high thermal conductivity is preferably performed in such a way that the electronic board 3 is at least partially sunk in the polymeric material with high thermal conductivity.

In other words, said step of moulding polymeric material with high thermal conductivity comprises completely covering the first face 3*a* and at least part of the second face 3*b* of the electronic board 3.

In other words, during the moulding step, the polymeric material with high thermal conductivity covers the first face 3*a* of the electronic board 3 and creeps into the space or gap between the second face 3*b* and the back wall 7*b* of the lateral seat 7.

It should be noted that, preferably, the polymeric material with high thermal conductivity only covers part of the second face 3*b* of the electronic board so as to leave the connectors 3*c* uncovered.

Advantageously, in this way, with a single processing step, the electronic board 3 is mechanically protected, because it is sunk, electrically insulated and can be cooled easily.

In fact, the use of an over-moulded polymeric material makes it possible to avoid the step of applying resin to the electronic board after said moulding step and/or before closing the seat.

Moreover, the step of moulding the polymeric material with high thermal conductivity preferably comprises designing the protection element 8 in such a way that an exposed portion 8*a* thereof, which covers the first face 3*a* of the electronic board 3, comprises a plurality of heat exchange fins 9 that lead off away from said lateral seat 7.

After or before moulding the polymeric material with high thermal conductivity, the electric/electronic means 2, as described above, are housed in the containment chamber 6 and connected to the electronic board 3 (by means of the connectors 3*c*).

The invention achieves its intended purposes and significant advantages are thus obtained.

In fact, the manufacturing of a "smart" coil, with an on-board electronic board sunk in a polymeric material with high conductivity, is very fast and therefore inexpensive for the manufacturer.

At the same time, such a coil shows very high performances in terms of heat exchange, which results in a great advantage for the car makers, allowing to exploit it to the full.

The invention claimed is:

1. An ignition coil for an internal combustion engine, comprising:

a containment body including a containment chamber, defining an internal volume, and a lateral seat facing outwards, away from said containment chamber, wherein said containment body comprises an opening that connects said containment chamber and said lateral seat;

an electric/electronic circuit for generating high-voltage electrical energy housed in said containment chamber;

an electronic board electrically connected to said electric/electronic circuit and arranged in said lateral seat, the electronic board comprising one or more connectors facing towards said opening to allow the electronic board to contact the electric/electronic circuit;

a protection element to protect said electronic board;

wherein said protection element is made of a polymeric material with high thermal conductivity over-molded on said electronic board to close the lateral seat, cover the electronic board, and define a sole interface between the electronic board and an external environment.

2. The ignition coil as claimed in claim 1, wherein the thermal conductivity of said protection element is higher than that of the containment body and is comprised between 0.50 and 5.00 W/mK.

3. The ignition coil as claimed in claim 2, wherein the thermal conductivity of said protection element is approximately 2.50 W/mk.

4. The ignition coil as claimed in claim 1, wherein said electronic board is arranged in said lateral seat in such a way that:

a first face thereof faces outwards from the lateral seat;

a second face thereof, opposite the first face, faces a back wall of the lateral seat, and is spaced apart from the back wall;

wherein said protection element is over-molded on said electronic board so as to cover the first face and at least part of said second face.

5. The ignition coil as claimed in claim 4, wherein said protection element is over-molded on said electronic board to leave to said one or more connectors uncovered.

6. The ignition coil as claimed in claim 1, wherein said protection element comprises a plurality of heat exchange fins that lead off away from said lateral seat to assist cooling of the electronic board.

7. The ignition coil as claimed in claim 1, wherein the containment body is made of a reinforced polymeric material.

8. The ignition coil as claimed in claim 7, wherein the reinforced polymeric material is reinforced with glass fiber.

9. A method for manufacturing an ignition coil for an internal combustion engine, comprising the steps of:

manufacturing a containment body including a containment chamber, defining an internal volume, and a lateral seat facing outwards, away from said containment chamber;

preparing an electronic board including a first face and a second face, opposite the first face;

positioning said electronic board inside said lateral seat;

molding a polymeric material with high thermal conductivity on said electronic board to cover the electronic board and define a sole interface between the electronic board and an external environment.

10. The method as claimed in claim 9, wherein said step of positioning the electronic board is performed by placing the board in the lateral seat in such a way that:

the first face faces outwards from the lateral seat;

the second face faces a back wall of the lateral seat, spaced apart from the back walk.

11. The method as claimed in claim 9, wherein the step of molding the polymeric material with high thermal conductivity is performed in such a way that the electronic board is at least partially sunk in the polymeric material with high thermal conductivity.

12. The method as claimed in claim 11, wherein the step of molding the polymeric material with high thermal conductivity consists of:

completely covering the first face of the electronic board;

partially covering the second face of the electronic board, leaving uncovered one or more connectors that protrude from said second face.

13. The method as claimed in claim 9, wherein the step of manufacturing the containment body is performed by molding plastic material in a press.

14. The method as claimed in claim 9, wherein there is no step of applying resin to the electronic board after said molding step.

* * * * *